United States Patent [19]

Yamada et al.

[11] 4,040,941

[45] Aug. 9, 1977

[54] PROCESS FOR LIQUEFYING COAL

[75] Inventors: Yasuhiro Yamada; Hidemasa Honda; Hitoo Kakiyama, all of Tosu, Japan

[73] Assignee: Director-General of the Agency of Industrial Science and Technology, Tokyo, Japan

[21] Appl. No.: 632,656

[22] Filed: Nov. 17, 1975

[51] Int. Cl.[2] ..... C10G 1/04

[52] U.S. Cl. ..... 208/8

[58] Field of Search ..... 44/23, 51, 61; 208/8

[56] References Cited

U.S. PATENT DOCUMENTS

| | | | |
|---|---|---|---|
| 1,561,322 | 11/1925 | Goskar | 44/23 |
| 3,642,608 | 2/1972 | Roach et al. | 208/8 |

*Primary Examiner*—Daniel E. Wyman
*Assistant Examiner*—Mrs. Y. Harris-Smith
*Attorney, Agent, or Firm*—William J. Daniel

[57] ABSTRACT

A process for liquefying coal to produce liquid fuel and pitch-like substances suitable as starting materials for various carbonaceous materials, which process comprises incorporating powdery coal with a heavy oil of petroleum series having a high carbon content of at least 0.9 in terms of the atomic ratio C/H in an amount of at least 50 parts by weight per 100 parts of the powdery coal, subjecting the mixture to a heat treatment conducted at 320°-400° C for 0.5-10 hours thereby liquefying the coal.

7 Claims, No Drawings

PROCESS FOR LIQUEFYING COAL

BACKGROUND OF THE INVENTION

The present invention relates to a process for the production of liquid fuel wherein coal is effectively liquefied. More particularly, the present invention relates to a process for efficiently liquefying coal wherein a heavy oil of petroleum series having a high carbon content is used as starting material and subjected to a heat treatment conducted at a relatively low temperature.

Coal has been used as fuel for a very long period of time from the beginning of human history. With the increasing output of petroleum in recent years, however, the position of coal as industrial and domestic energy source is being replaced by petroleum. Major reasons therefor are that coal is solid and is incovenient in storage and transport as compared with liquid petroleum, that coal contains a large amount of ashes and that coal is low in combustion effiiency.

In order to improve these shortcomings of coal, various attempts have been to liquefy coal. The methods for liquefying coal are roughly classified into a hydrogenolyzing method and a solvent treatment method, the former comprising the treatment of coal at a high temperature with highly pressurized hydrogen for producing chiefly light oils such as gasoline and the latter comprising the steps of mixing coal with a heavy oil solvent of coal series such as creosote oil, anthracene oil and coal tar and subjecting the mixture to a heat treatment to produce heavy oils.

On the other hand, many researches have been made on effective utilization of heavy oils of petroleum series produced in a large amount as by-product with the recent increase in consumption of petroleum. One of the key problems is utilization of the heavy oils as a solvent for liquefaction of coal. However, heavy oils of petroleum series are hardly miscible with those of coal series and thus fail to exhibit satisfactory extraction efficiency. Hitherto, therefore, no success has been reported in attempts to liquefy coal with a heavy oil of petroleum series.

Afterwards, the present inventors developed a process for the production of liquid fuels of good quality which comprises incorporating powdery coal with a heavy oil of petroleum series in an amount of at least 50 parts by weight per 100 parts by weight of the powdery coal, subjecting the mixture to a heat treatment conducted at 400°–450° C and thereafter removing a solid coagulated material formed in the treated product (U.S. Pat. application Ser. No. 549,360).

As this process requires a treating temperature as high as 400° C or more, however, the process involves problems to be improved in the aspects of thermal energy and operation conditions.

BRIEF SUMMARY OF THE INVENTION

Accordingly, it is an object of this invention to provide an improvement in the method for liquefying coal to obtain a pitch product which can be used as fuel or various carbonaceous materials.

It is another object of this invention to provide a process for liquefying coal wherein a mixture of coal and a heavy oil of petroleum series is subjected to a heat treatment conducted at a relatively low temperature.

It is further object of this invention to provide modified heavy oils of petroleum series suitable as solvents for liquefaction of coal.

Other objects and aspects of this invention will become apparent from the following description of embodiments.

DETAILED DESCRIPTION OF THE INVENTION

It has now been found that when a pitch product obtained by heating asphalt at a temperature of 350°–450° C, preferably 400°–430° C, until an atomic ratio C/H of the product becomes at least 0.9 is used as a solvent for liquefaction of coal, a homogeneous pitch-like substance is obtained by a heat treatment conducted at a temperature below 400° C, i.e. a temperature of 320°–400° C.

In accordance with the present invention, therefore, coal can be liquefied to produce a homogeneous pitch-like substance by mixing powdery coal with a pitch product obtained by heating asphalt at a temperature of 350°–450° C, preferably 400°–430° C, until an atomic ratio C/H of the asphalt becomes at least 0.9 in a mixing ratio by weight of 2 : 1 to 1 : 10, preferably 1 : 1 to 1 : 2 to the powdery coal, and then heating the mixture for 0.5–10 hours at a temperature within a range of 320°–400° C.

Preferable examples of coal to be liquefied in the process of the present invention include bitumious coal and brown coal. Usually, the coal is divided finely and used in the form of powders capable of passing through a Tylers's standard sieve of at least 40 mesh.

Utilizable as solvent in the process of the present invention is a pitch product obtained by heating asphalt at a temperature within a range of 350°–450° C, preferably 400°–430° C, until an atomic ratio C/H in the asphalt becomes at least 0.9. Asphalt utilizable for this purpose includes, in addition to straight asphalt, tars obtained as by-product in thermal cracking of naphtha. Usually, a period of time as long as 30 minutes to 3 hours is required until the atomic ratio C/H becomes 0.9 or more. The treating time in this case in a function of the treating temperature. Accordingly, the treating time becomes shorter as the treating temperature becomes higher but the treating time becomes longer as the treating temperature becomes lower.

In an embodiment of the process of the present invention, powdery coal is mixed with heavy oil of petroleum series having a high carbon content of at least 0.9 in terms of the atomic ratio C/H prepared as described above in a mixing ratio by weight of 2 : 1 to 1 : 10, preferably 1 : 1 to 1 : 2, to the powdery coal, and thereafter the mixture is heated at 320°–400° C under agitation to effect liquefaction of the coal. The time required for this liquefaction is usually within an extent from 30 minutes to 10 hours and becomes shorter as the treating temperature becomes higher but becomes longer as the treating temperature becomes lower. If the amount of the heavy oil in this case becomes smaller than the above mentioned ratio to the powdery coal, stirring of the mixture will become difficult. On the other hand, if the ratio of the heavy oil to the powdery coal becomes larger than the above defined upper limit, liquefaction of the powdery coal will become easy but the significance of liquefying coal will be lost. If the treating temperature in the process of the present invention is lower than the above mentioned range, dissolution of the powdery coal in the solvent will become unsatisfactory and, as the result, liquefaction of the powdery coal wll not proceed smoothly. On the other hand, if the treating temperature becomes higher than the above mentioned range, carbonization of the mixture will take place quickly so that a homogeneous product will no longer be obtained. A preferable treating temperature is around the temperature at which the powdery coal begins to be softened by heat.

The pitch-like substance having a homogeneous appearance is thus produced which, according to observation using a polarization microscope, is found substantially free of coal particles.

The pitch-like substance obtained according to the process of this invention is useful as liquid fuel or a starting material for various carbonaceous materials. For example, the pitch-like substance is dissolved in an organic solvent such as quinoline, pyridine or nitrobenzene, anthracene oil or creosote oil and the solution is separated from insoluble matters and then stripped by removing the solvent whereby a homogeneous mixture of a heavy oil and coal dissolved therein is obtained. The mixture thus obtained is diluted with anthracene oil or creosote oil to reduce the viscosity whereby a heavy oil-like liquid fuel is obtained. In case an oil is used for separation of insoluble matters from the mixture, the oil is removed until the viscosity reaches a given value whereby the desired liquid fuel is obtained. The liquid fuel thus obtained is similar to heavy oil and substantially free of ashes and has an extremely high calorie.

This invention will now be illustrated in more detail by way of examples. It is to be construed however that these examples are not given for the purpose of limiting the scope of the invention.

EXAMPLE 1

Straight asphalt (atomic ratio C/H = 0.7) obtained from Kafji crude oil was heated under normal pressure at 420° C for 60 minutes in a stream of nitrogen, whereby a thermally cracked oil (43.6%), a pitch (50.3%) and a gaseous component (6.1%) were obtained. The pitch contained a quinoline-insoluble component (3.1%) and had an atomic ratio C/H of 1.0. One part by weight of this pitch was mixed with one part by weight of powdery Miike coal (average particle diameter: 0.3 mm; ash content: 7.1 %) and the mixture was heated at 250° C and stirred so that both ingredients were mixed thoroughly. The mixture was then heated up to 400° C at a temperature elevation rate of 3° C per minute and maintained at this temperature for 60 minutes. A pitch-like substance (96.3%) and a cracked oil (1.0%) were thus obtained. A content of a quinoline-insoluble component in the pitch-like substance was 10.3%. According to observation using a polarization microscope, no coal particle was found in the structure of the pitch-like substance.

From a quinoline solution of a quinoline-soluble component of the pitch-like substance, the quinoline was removed by distillation under reduced pressure. The residue was diluted with an equiamount of creosote oil and heated at 100° C whereby the residue was dissolved in creosote oil to form a heavy oil-like liquid fuel which is fluid at room temperature. This liquid fuel had a calorific value of 9800 cal/g.

EXAMPLE 2

Two parts by weight of asphalt heated as described in Example 1 were admixed with one part by weight of Miike coal and the mixture was subjected to heat treatments conducted for 60 minutes at 360° C, 380° C and 400° C. The yields of a pitch-like substance and a cracked oil thus obtained and the amount of a quinoline-insoluble component in the pitch-like substance are shown in the following table.

| Temperature in the heat treatment (° C) | Yield (%) Pitch-like substance | Cracked oil | Content of a quinoline-insoluble component in the pitch-like substance |
|---|---|---|---|
| 360 | 95.9 | 1.3 | 9.2 |
| 380 | 94.8 | 1.3 | 7.5 |
| 400 | 90.9 | 3.3 | 9.6 |

EXAMPLE 3

An equivolume mixture of Kafji crude oil, Gachsaran crude oil and Kuwait crude oil was distilled under reduced pressure and asphalt obtained as residue was subjected to a heat treatment conducted at 400° C for 60 minutes whereby a pitch (51.9%) and a cracked oil (42.6%) were obtained. This pitch contained a quinoline-insoluble component (0.6%) and had an atomic ratio C/H of 0.9. 50 parts by weight of this pitch were admixed with 100 parts by weight of Miike coal and the mixture was molten under agitation by heating at 350° C and then maintained at 380° C for 90 minutes whereby a pitch-like substance (81.6%) and a cracked oil (10.3%) were obtained. A content of a quinoline-insoluble component in the pitch-like substance was 15.8%. A result of a microscopic observation of the structure of the pitch-like substance by the aid of a polarization microscope revealed that a very small amount of fine coal particles remained in the pitchlike substance.

EXAMPLE 4

A tar (atomic ratio C/H = 0.6) obtained as by-product in thermal cracking of naphtha was heated at 370° C for 3 hours whereby a pitch having an atomic ratio C/H of 0.91 was obtained in a yield of 40.3 %. 600 Parts by weight of the pitch thus obtained were mixed with 100 parts by weight of Miike coal and the mixture was heated under agitation at 330° C for 6 hours. A homogeneously mixed pitch-like substance was thus obtained.

What is claimed is:

1. A process for liquefying coal, characterized by mixing a pitch obtained by heating asphalt at a temperature of 350°–450° C for a time of about 0.5-3 hours and until an atomic ratio C/H of said asphalt becomes at least 0.9 with a sufficient amount of powdery coal to give a mixing ratio by weight of 2:1 to 1:10 of pitch to said powdery coal, and then heating the mixture for 0.5–10 hours at 320°–400° C to substantially dissolve said coal in said pitch and form a substantially homogeneous mixture substantially free of undissolved coal particles.

2. A process according to claim 1 wherein said asphalt is straight asphalt.

3. A process according to claim 1 wherein said asphalt is a naphtha tar.

4. A process according to claim 1 wherein the temperature during conversion of said asphalt into said pitch is selected from a temperature range of 400°–430° C.

5. A process according to claim 1 wherein said powdery coal is mixed with said pitch in a mixing ratio of 1 : 1 to 1 : 2 to said powdery coal.

6. A process according to claim 1 wherein a mixture of said pitch and said powdery coal is heated at 360°–390° C.

7. A process according to claim 1 wherein said substantially homogeneous mixture is diluted with a sufficient amount of anthracene or creosote oil to form a fuel which is liquid at room temperature.

* * * * *